United States Patent [19]

Montoya

[11] 4,259,030

[45] Mar. 31, 1981

[54] GROUND ANCHOR

[76] Inventor: Raul Montoya, 4481 N. Emerson, Fresno, Calif. 93705

[21] Appl. No.: 35,780

[22] Filed: May 3, 1979

[51] Int. Cl.[3] ..... E02D 17/00

[52] U.S. Cl. ..... 405/303; 405/142; 405/282

[58] Field of Search ..... 405/142, 146, 148, 150, 405/272, 282, 283, 303; 52/155

[56] References Cited

U.S. PATENT DOCUMENTS

| | | | |
|---|---|---|---|
| 1,137,442 | 4/1915 | Abbott | 405/150 X |
| 1,843,334 | 2/1932 | McGrath | 405/150 X |
| 2,866,320 | 12/1958 | Bazzell | 405/283 |
| 3,903,707 | 9/1975 | Foik | 405/142 |

*Primary Examiner*—David H. Corbin

[57] ABSTRACT

Herein described is an anchor for use in an open earth trench which is adapted for use with equipment performing construction functions within the trench. A cable is attached to a winch on the equipment and to the anchor. The equipment is moved along by the winch. The anchor is comprised of a pair of elongated concave sleeve sections each being hinged together at the bottom of the trench. A plurality of earth engaging blades are disposed on the outer periphery of the sleeve section. The blades are angled in the direction of pull. A pair of top ribs are placed longitudinally along the top of the sleeve sections form a channel for engaging the walls of the trench to prevent upward movement of the anchor. A first arm has one end thereof pivotally mounting to the interior side of one of the sleeve sections. A second arm has a first end pivotally mounted to interior side of the second sleeve section. Each of the arms then extend upwardly at an angle towards each other and the second ends of each arm are pivotally mounted together. As the pivotally connected arms are drawn downwardly toward the bottom of the first and second sleeve section, the sleeves are forced away from each other, causing the plurality of angled blades and the top ribs to engage the earth at the trench. A pulley is disposed on the bottom of one of the sleeve sections and a cable is coupled to an eye connected to the pivot point of the second ends of the arms and engages the pulley. The cable is then coupled to winch on the equipment used to perform the construction within the trench.

16 Claims, 5 Drawing Figures

GROUND ANCHOR

BACKGROUND OF THE INVENTION

This invention relates to anchor equipment and more particularly to novel and improved anchor equipment which is adapted to be disposed within an open trench to anchor a cable thereto which is used to pull construction equipment along the trench.

An example of the type construction equipment is, for example, equipment used to construct concrete pipe which is cast in place in a manner well known to those skilled in the art. For example, a cast-in-place concrete pipe section is constructed in a manner whereby a machine is placed directly into the trench and concrete is fed into the machine where it is tamped and vibrated and poured into the trench forming the pipe as the machine actually moves along the trench. This type of machine is well known to those skilled in the art and no attempt shall be made to explain its operation and function in this application.

Heretofore, in order to move the machine along the trench, a piece of heavy equipment was attached to the machine and would pull it along at a regulated speed.

Another method heretofore used is to provide a winch on the machine and couple a cable onto the winch and the other end thereof to a piece of equipment spaced a distance along the trench. Such anchoring equipment, heretofore used, was a backhoe, for example.

The present invention overcomes all the disadvantages of the prior art in that it provides a novel and improved earth engaging anchor of the present invention which is placed directly into the trench. A cable from the winch on the equipment desired to be moved is coupled to the earth engaging anchor. As pressure is placed on the anchor, the earth engaging blades on the anchor becomes more deeply entrenched into the sidewalls of the trench and becomes more firmly secured to the sidewalls and bottom of the trench as pressure is applied.

SUMMARY OF THE INVENTION

Briefly described, the present invention comprises an anchor for use in an open trench. The anchor includes a first elongated concave sleeve section which has a longitudinal axis and is adapted to be disposed horizontally in one side of the open trench. A second elongated concave sleeve section which has a similar longitudinal axis is also disposed horizontally in the open trench and adjacent the first sleeve portion. Each sleeve portion is then hinged together along the bottom of the trench at the outer edges thereof. Each section then forms a semicircular concave cylinder. At the top of each sleeve section and positioned longitudinally therewith are a pair of spaced parallel ribs forming a channel therebetween. A plurality of earth engaging blades are mounted on the outer sides of each of the sleeves and are adapted to engage the earth on each side of the open trench. The blades may be angled in a helical curve to engage the earth, the blades on one sleeve are angled opposed to the blade on the other sleeve. Means are included within the inside of each sleeve to force the sleeves away from each other, pivoting on the hinged area, causing the earth engaging blades to engage the sidewalls of the open trench, and at the same time causing the spaced top ribs to engage the trench to prevent the anchor from rising. This latter mentioned earth engaging means includes a first arm which is pivotally mounted to the inner side of the first sleeve near the bottom rib of the spaced parallel ribs and a second arm which is pivotally mounted to the inner side of the second sleeve near the bottom rib of the spaced parallel ribs. The free ends of the arms are then pivotally mounted together. An eye is coupled to the arms at the pivot point and a pulley is mounted on the inner side of the sleeves. A cable is coupled to the eye and is placed through the pulley. By applying pressure to the cable the arms are pulled downwardly causing the sleeves to be forced away from each other. The blades then become entrenched into the sides of the trench.

A winch placed upon a piece of earth working machine then draws upon the cable causing the anchor to open and dig into the trench. The cable is then used to move the machine towards the anchor. The more pressure applied to the cable the tighter the anchor will hold.

This eliminates the need for the use of equipment to either hold the cable in place or machinery to impart movement of the machine.

DESCRIPTION OF THE DRAWINGS

These and other advantages will become more apparent to those skilled in the art when taken into consideration with the following detailed description wherein like reference numerals indicate like and corresponding parts throughout the several views and wherein.

DESCRIPTION OF ONE PREFERRED EMBODIMENT

Figure 1:
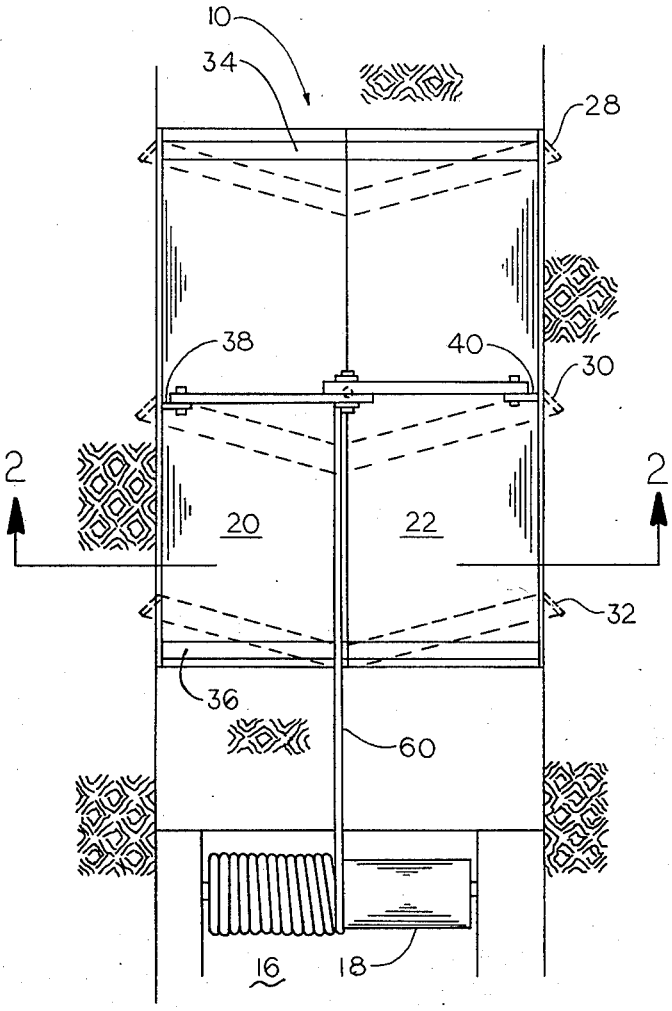
FIG. 1 is a top plan view of the anchor construction of the present invention illustrating the position of the trench and having a winch attached thereto.
Figure 2:
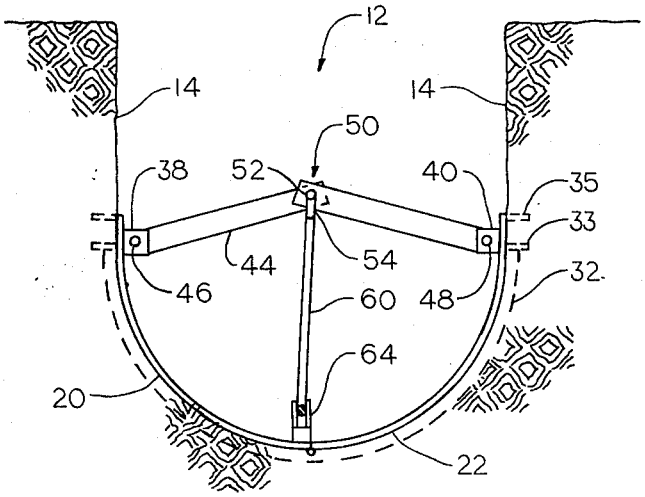
FIG. 2 is a section view taken along the line of 2—2 of FIG. 1 showing the anchor in the trench.

In the present invention there is shown generally in FIGS. 1 and 2 the anchor 10 of the present invention as it is placed within a trench 12, for the purpose of the description the trench is normally a concave shaped ditch dug into the earth for the purpose of laying pipe or other similar type of construction work.

The anchor 10 and the preferable construction equipment 16 is positioned within the walls of the trench 14. The construction equipment 16 has a winch 18 mounted thereon which is used to urge the construction equipment toward the anchor 10 in a manner yet to be described.

Figure 3:
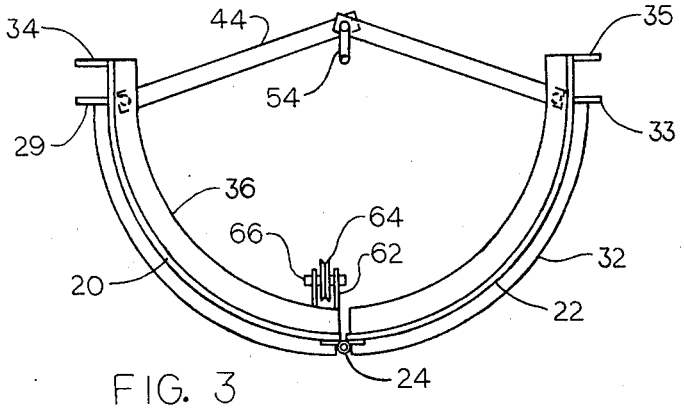
FIG. 3 is a view of the anchor removed from the trench.
Figure 4:
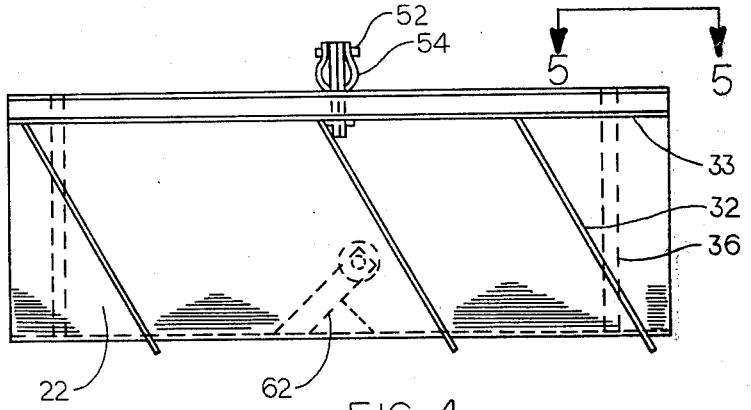
FIG. 4 is a side view of the anchor of FIG. 3 shown outside the trench.
Figure 5:
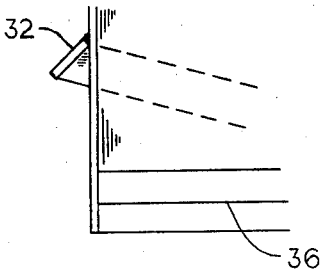
FIG. 5 is a partial section view taken along lines 5—5 of FIG. 4 showing a preferred view of the blades.

The anchor 10 comprises a first sleeve section 20 and a second sleeve section 22. Each of these sleeve sections 20 and 22 are coupled together by the hinge 24 best shown in FIG. 3. The first sleeve section 20 and the second sleeve section 22 are symmetrical in design and formed a sectional sleeve having a concave inner portion and a convex outer portion.

In the preferred embodiment shown there are three blades, 28, 30 and 32, which are fixed to the outer periphery of the sleeves of the first and second sleeve section. The blades are broken at the hinge area and coupled thereto in a suitable manner, these blades 28, 30 and 32 protrude outwardly from the outer walls of each of the sleeve sections 20 and 22.

A pair of spaced ribs 29 and 31 are positioned along the tops of sleeve section 20 and parallel to each other forming a channel therebetween. A second pair of spaced ribs 33 and 35 are positioned along the top of sleeve section 22 and parallel to each other and also forming a channel therebetween. These ribs 29, 31 and 33, 35 are used to maintain the anchor 10 from rising from the trench when pressure is placed thereon as hereinafter to be explained.

As is shown in the described embodiment the blades 36 are angled on each sleeve in an opposing position to form opposing helical angles. This angle on the blade adds an advantage in that the angle being in the direction of pull causes the blades to become deeper entrenched into the sidewalls 14 of the trench 12 as pressure is placed in the pulling direction as hereinafter to be explained.

A pair of mounting brackets 38 and 40 extend inwardly from the inner periphery of each sleeve, near the bottom ribs 29 and 33 respectively. Each bracket, 38 and 40 is mounted to an opposite sleeve 20 and 22, respectively.

A pair of arms, 42 and 44, are pivotally coupled to the brackets 38 and 40, respectively, in a suitable manner by the pivot pins 46 and 48. Each arm extends inwardly and upwardly at an angle from the innermost perimeter of the sleeves sections 20 and 22 and are coupled together at point 50 by a pivot pin 52. The pivot pin 52 may have an eye 54. A cable 60 is connected to the eye 54.

A mounting bracket 62 is coupled to the bottom of sleeve section 20 on the inner periphery thereof and has a pulley 64 mounted by a suitable pin 66, the cable 60 coupled to the eye 54 extends through the pulley 64 and is stretched the distance of the trench 12 to the winch 18 of the construction equipment 16.

In operation of the shown embodiment of this invention, it may be desired that certain construction equipment 16 as shown in FIG. 1 be drawn through an open trench 12 toward a certain point to where the anchor 10 is positioned. In order to do this, a winch 18 is coupled to the equipment 16 and turned by a suitable means such as a motor or engine or the like, (not shown).

The anchor of the present invention is coupled directly to the winch 18 by the cable 60. As the cable is drawn tight, it pulls the pivot point 20 of the two arms 42 and 44 downwardly toward the pulley 64, causing the first sleeve section and second section to be forced outwardly from each other. Not only does this cause the blades 28, 30 and 32 to become deeply imbedded into the trench walls 14 of the trench 12, anchoring the sleeves firmly in place, but also it causes the ribs 29, 31 and 33, 35 to become imbedded in the side walls 14 of the trench preventing the anchor 10 from rising in the trench. The tighter the winch 18 pulls on the cable 60, the deeper the blades 28, 30 and 32 dig into the side walls 14 of the trench 12, thus causing the anchor to be anchored into position and allowing the earth moving equipment to be drawn toward the anchor 10. Because of the helical shape of the blades 36, the more pressure applied to cable, the deeper the blades become wedged into the earth.

The present invention will also work well in a square shaped trench because the curved shape blades 36 cause the blades to be imbedded in three parts, top and sides.

While there has been but one preferred embodiment of this invention, what is claimed is:

1. An anchor for use in an open trench, said anchor comprising:
   - a first elongated, concave sleeve section, said first sleeve section having a longitudinal axis and an inner side and an outer side;
   - a second elongated, concave sleeve section, said second sleeve section having a longitudinal axis and an inner side and an outer side;
   - means disposed along the longitudinal axis of said first sleeve section and said second sleeve section for pivotally mounting said first sleeve section to said second sleeve section;
   - a plurality of earth engaging blades mounted on the outer side of said first sleeve section and said second sleeve section; and
   - urging means mounted in the inner side of said sleeve section for urging said sleeve sections away from each other, causing said blades to extend outwardly and engage the sides of said open trench, upon application of a pulling force to said anchor in a direction generally aligned with said longitudinal axes of said sleeves.

2. The anchor as defined in claim 1 and wherein said urging means including:
   - a first arm having a first end being pivotally mounted to the inner side of said first sleeve section and a second end;
   - a second arm having a first end pivotally mounted to the inner side of said second sleeve section and a second end, said second end being pivotally mounted to the second end of said first arm; and
   - means for pivoting the first end of said first arm and the first end of said second arm away from each other.

3. The anchor as defined in claim 1 and further including means coupled to said anchor for preventing said anchor from rising in the open trench.

4. The anchor as defined in claim 3 where said means for preventing said anchor from rising in the open trench including at least one rib longitudinally disposed along the top peripheral edge of said first sleeve section and said second sleeve section.

5. The anchor as defined in claim 1 wherein said blades are angularly disposed on said sleeve section forming a helical shape.

6. The anchor as defined in claim 5 wherein the blades are angularly disposed on said first sleeve section on an angle opposite the angular disposition of the blades on said second sleeve section.

7. The anchor as defined in claim 6 wherein said blades are angled in the direction of the pull on the anchor.

8. An anchor for use in an open trench to anchor a cable to the walls of a trench so that construction equipment can be urged along said trench including:
   - a first elongated, concave sleeve section, said first sleeve section having a longitudinal axis, an inner side and an outer side, said first sleeve section being adapted to be horizontally disposed in the bottom of said open trench;
   - a second elongated, concave sleeve section, said second sleeve section having a longitudinal axis, an inner side and an outer side, said second sleeve section is adapted to be horizontally disposed in said open trench adjacent first sleeve section;

a plurality of earth engaging blades mounted on the outer sides of said first sleeve section and said second sleeve section and being adapted to engage the side walls of said trench; and urging means mounted on the inner sides of said sleeve sections for urging said sleeve sections away from each other, causing said blades to engage said trench walls and for anchoring said anchor in said trench to prevent movement of the anchor in said trench, upon application of a pulling force to said anchor in a direction generally aligned with said longitudinal axes of said sleeves.

9. The anchor as defined in claim 8 and wherein said urging means including said first arm, having a first end being pivotally mounted to the inner side of said first sleeve section and having a second end;

a second arm having a first end pivotally mounted to the inner side of said second sleeve section and having a second end, said second end of said second arm being pivotally mounted to the second end of said first arm;

means for drawing the second end of said first arm and the second end of said second arm downwardly, causing said sleeves to be urged away from each other.

10. The anchor as defined in claim 8 and further including means coupled to said anchor for preventing said anchor from rising in the open trench.

11. The anchor as defined in claim 10 wherein said means including at least one rib longitudinally disposed along the top peripheral edge of said first sleeve section and said second sleeve section.

12. The anchor as defined in claim 8 wherein said blades are angularly disposed on said sleeve section forming a helical shape.

13. The anchor as defined in claim 12 wherein the blades are angularly disposed on said first sleeve section on an angle opposite the blades on said second sleeve section.

14. The anchor as defined in claim 13 wherein said blades are angled in the direction of the pull on the anchor.

15. An anchor for use in an open trench, said anchor comprising:

a first elongated concave sleeve section, said first sleeve section having a longitudinal axis and an inner side and an outer side;

a second elongated sleeve section, said second sleeve section having a longitudinal axis and an inner side and an outer side;

means disposed along the longitudinal axis of said first sleeve section and said second sleeve section for pivotally mounting said first sleeve section to said second sleeve section;

a plurality of blades mounted on the outerside of said first sleeve section and said second sleeve section; and urging means mounted in the inner side of said sleeve section for urging said sleeve sections away from each other causing said blades to extend outwardly; said urging means including;

a first arm having a first end being pivotally mounted to the inner side of said first sleeve section and a second end, a second arm having a first end pivotally mounted to the inner side of said second sleeve section and a second end, said second end of said first arm being pivotally mounted to the second end of said second arm at a pivot point, and means for pivoting the first end of said first arm and the first end of said second arm away from each other, said pivot means including a pully mounted on one end of said sleeve sections, an eye coupled to the pivot point of said first arm and said second arm, and a cable coupled to said eye and engaging said pulley.

16. An anchor for use in an open trench to anchor a cable to the walls of a trench so that construction equipment can be urged along said trench including:

a first elongated, concave sleeve section, said first sleeve section having a longitudinal axis, an inner side and an outer side, said first sleeve section being adapted to be horizontally disposed in the bottom of said open trench;

a second elongated, concave sleeve section, said second sleeve section having a longitudinal axis, an inner side and an outer side, said second sleeve section is adapted to be horizontally disposed in said open trench adjacent said first sleeve section;

a plurality of earth engaging blades mounted on the outer sides of said first sleeve section and said second sleeve section and being adapted to engage the side walls of said trench; and urging means mounted on the inner sides of said sleeve sections for urging said sleeve sections away from each other, causing said blades to engage said trench walls and for anchoring said anchor in said trench to prevent movement of the anchor in said trench; wherein said urging means including;

a first arm having a first end pivotally being mounted to the inner side of said first sleeve section and having a second end, a second arm having a first end pivotally mounted to the inner side of said second sleeve section and having a second end, said second end of said second arm being pivotally mounted to the second end of said first arm at a pivot point and means for drawing the second end of said first arm and the second end of said second arm downwardly causing said sleeves to be urged away from each other, said drawing means includes a pulley disposed in said first sleeve, an eye coupled to the pivot point of said first arm and said second arm, a cable coupled to said eye and through said pulley, and a winch adapted to be attached to the construction equipment whereby the cable is coupled to said winch and being adapted to be drawn toward said winch where said winch is engaged.

* * * * *